US009593480B2

(12) United States Patent
Vandenbempt

(10) Patent No.: US 9,593,480 B2
(45) Date of Patent: Mar. 14, 2017

(54) BUILDING BLOCK, AS WELL AS AN INSERT PIECE TO BE APPLIED IN SUCH A BUILDING BLOCK

(71) Applicant: VANDENBEMPT PATENT CV, Rotselaar (BE)

(72) Inventor: Patrick Vandenbempt, Kessel-lo (BE)

(73) Assignee: VANDENBEMPT PATENT COMM. V, Leuven (BE)

( * ) Notice: Subject to any disclaimer, the term of this patent is extended or adjusted under 35 U.S.C. 154(b) by 0 days.

(21) Appl. No.: 14/388,974

(22) PCT Filed: Mar. 29, 2013

(86) PCT No.: PCT/IB2013/052537

§ 371 (c)(1),
(2) Date: Sep. 29, 2014

(87) PCT Pub. No.: WO2013/144913

PCT Pub. Date: Oct. 3, 2013

(65) Prior Publication Data

US 2015/0075106 A1 Mar. 19, 2015

(30) Foreign Application Priority Data

Mar. 30, 2012 (BE) ..... 2012/0216

(51) Int. Cl.
*E04B 5/04* (2006.01)
*E04B 2/18* (2006.01)
(Continued)

(52) U.S. Cl.
CPC ..... *E04B 2/18* (2013.01); *E04B 1/40* (2013.01); *E04B 2/26* (2013.01); *E04C 1/00* (2013.01);
(Continued)

(58) Field of Classification Search
CPC ..... A63H 33/086; A63H 33/108; E04C 1/40; E04C 1/00; E02D 29/0266; B28B 7/183;
(Continued)

(56) References Cited

U.S. PATENT DOCUMENTS 2,700,295 A * 1/1955 Gilde ..... 52/302.4
4,110,949 A * 9/1978 Cambiuzzi et al. ..... 52/437
(Continued)

FOREIGN PATENT DOCUMENTS

EP 1498555 1/2005
EP 1624118 2/2006
(Continued)

OTHER PUBLICATIONS

International Search Report for PCT/IB2013/052537, Completed by the European Patent Office on Jul. 8, 2013, 3 Pages.

*Primary Examiner* — Brian Mattei
*Assistant Examiner* — Gisele Ford
(74) *Attorney, Agent, or Firm* — Brooks Kushman P.C.

(57) ABSTRACT

A building block formed of a body having one or more insert pieces, whereby first and second complementary coupling parts are mainly formed of the one or more synthetic insert pieces so as to be able to couple such building blocks to one another. The first and the second coupling parts are complementary in such a way that, after the adjacent building blocks have been coupled to one another in an immobile manner.

11 Claims, 8 Drawing Sheets

(51) Int. Cl.

| | |
|---|---|
| ***E04B 1/41*** | (2006.01) |
| ***E04B 2/26*** | (2006.01) |
| ***E04C 1/00*** | (2006.01) |
| *E04B 2/02* | (2006.01) |

(52) U.S. Cl.
CPC ..... *E04B 2002/0243* (2013.01); *E04B 2002/0245* (2013.01); *E04B 2002/0284* (2013.01)

(58) Field of Classification Search
CPC ..... B28B 7/24; E04B 2/18; E04B 2/16; E04B 2002/0215; E04B 2/08; E04B 2/46; E04B 2002/0228; E04B 2002/0243; E04B 2002/0282; E04B 2002/0284; E04B 2002/0245
See application file for complete search history.

(56) References Cited

U.S. PATENT DOCUMENTS

| | | | | |
|---|---|---|---|---|
| 4,905,439 | A * | 3/1990 | Filteau | 52/309.12 |
| 4,947,610 | A * | 8/1990 | Koerner | 52/585.1 |
| 6,161,357 | A * | 12/2000 | Altemus | 52/592.6 |
| 6,282,859 | B1 * | 9/2001 | Van Der Heijden | 52/585.1 |
| 2003/0029119 | A1 * | 2/2003 | Coleman | 52/604 |
| 2004/0128936 | A1 * | 7/2004 | Gilbert | E04B 2/46 52/604 |
| 2008/0075528 | A1 * | 3/2008 | Marzetta | 403/238 |
| 2011/0192097 | A1 * | 8/2011 | Kelley, Jr. | 52/166 |
| 2012/0252307 | A1 * | 10/2012 | Lin | 446/91 |
| 2012/0291383 | A1 * | 11/2012 | Zohar | 52/309.1 |
| 2013/0252504 | A1 * | 9/2013 | Chang et al. | 446/124 |

FOREIGN PATENT DOCUMENTS

| | | |
|---|---|---|
| FR | 2425512 | 12/1979 |
| FR | 2946069 | 12/2010 |

* cited by examiner

BUILDING BLOCK, AS WELL AS AN INSERT PIECE TO BE APPLIED IN SUCH A BUILDING BLOCK

CROSS-REFERENCE TO RELATED APPLICATION

This application is the U.S. national phase of PCT Application PCT/IB2013/052537 filed on Mar. 29, 2013, which claims priority to BE Patent Application No. BE2012/0216 filed on Mar. 30, 2012, the disclosures of which are incorporated in their entirety by reference herein.

The present invention concerns a building block, in particular a non-massive building block, usually also called fast building block in professional jargon.

More specifically, the invention concerns a building block for the construction of walls and partitions of a building or the like, and which is provided with coupling means having a first coupling part protruding from a first side of the building block and a second coupling part complementary thereto on an opposite second side of the building block, whereby the first coupling part and the second coupling part are complementary, and whereby during the assembly of several such building blocks, the first coupling part of a first building block and the second coupling part of an adjacent building block are made to work in conjunction.

By the side of a building block is meant here one of the usually six sides of a conventionally mainly beam-shaped building block, not taking into account any protruding bumps, teeth or ribs, nor any possible levels or the like. Further, such a side is also often called a (sur)face or a flank, with more specifically a pair of end faces, a top surface and a bottom surface and a pair of side flanks.

Such building blocks provided with coupling means for coupling building blocks are already known, but they have several disadvantages and restrictions.

The coupling means are usually formed of a complementary tongue and groove on opposite faces of the building block.

Also, such coupling means of the known building blocks are designed to obtain a good alignment of adjacent building blocks in a simple manner rather than to obtain a real coupling between the building blocks.

The obtained coupling is moreover such that it can resist small forces which run parallel to the sides or faces provided with coupling means, further also referred to as the coupling surfaces.

Another disadvantage of the known building blocks is that the coupling means are often quite rough and imprecise, leading to a moderate coupling or alignment of the building blocks.

Another disadvantage of such known building blocks provided with coupling means is that the actual connection between the building blocks must always be made by means of a mortar or glue or the like.

It is known that mortar or glue has restrictions in terms of processing time, is costly, requires experience or professional expertise, and soils the construction site as well as the construction being built.

The need for the use of mortar or glue shows, moreover, that coupling means of the known building blocks only perform a coupling function to a limited extent.

Moreover, detaching the building blocks which have been fastened together by means of mortar or glue is virtually impossible, or it will damage the building blocks considerably, or the building blocks are soiled by the mortar or glue to such an extent that they are not reusable.

Consequently, with the known building blocks, it is a costly operation if a wall composed of such building blocks has to be demolished, in whole or in part, for example due to an error made during the erection of the wall or if the client wants to adjust the design.

Also, the present invention aims to remedy one or several of the above-mentioned disadvantages of the known building blocks and possibly also other disadvantages thereof.

To this end, the invention concerns a building block for the construction of walls or partitions of a building or the like, which is provided with coupling means having a first coupling part protruding from a first surface of the building block and a second coupling part complementary thereto on an opposite surface of the building block, whereby the first coupling part and the second coupling part are complementary, and whereby during the assembly of several such building blocks, the first coupling part of a first building block and the second coupling part of an adjacent building block are made to work in conjunction in order to couple them, whereby the building block is formed of a body in which are provided one or several insert pieces, whereby the aforesaid first and second coupling parts are mainly formed of said one or several insert pieces, whereby the first coupling part and the second coupling part are complementary to such an extent that, after adjacent building blocks have been coupled, the coupled building blocks concerned are coupled in an immobile manner by making the coupling means concerned work in conjunction with one another.

A major advantage of a building block according to the invention consists in that the building block is made of a body on the one hand, and of one or several insert pieces on the other hand, which are each made of a material which is suitable for their purpose.

Typically, the body is made of stone, but also wood or even plastic or other materials are not excluded from the invention.

By stone is meant in this text any material which is customary for manufacturing building blocks, such as blocks made of conventional cast concrete, of cellular concrete made of a mixture of quartz sand, lime and cement, of silicate made of a mixture of quartz sand and lime or of a material based on a different mortar, or even baked clay and the like is not excluded.

An advantage is that the building block according to the invention offers many if not all the advantages of a traditional building block: can be produced in an economical manner, durable and structurally adapted to withstand stresses and influences on a building structure.

On the other hand, with a building block according to the invention, its coupling parts should be made of a rather tough material, preferably a synthetic material, but a metal such as aluminium or steel or any other material is not excluded either.

This is advantageous in that, as a result, the coupling parts can be finished in a very fine and precise manner and can take the most diverse forms, and whereby a synthetic is also advantageous in that it has a certain elasticity, and can also withstand reasonable tensile forces, which characteristic cannot be assigned to a stone component.

Only by making the coupling parts of a building block according to the invention of a tough material, such as a synthetic, can the building blocks be coupled to one another in an immobile manner, because of the precision and freedom of shape that a synthetic offers, whereas the coupling can also be undone by taking advantage of the elasticity of the synthetic.

According to a preferred embodiment of a building block according to the invention, two synthetic insert pieces are embedded in the stone part of the building block, each in the shape of a cylindrical hollow sleeve, which sleeves are located centrally between two side flanks of the building block, whereby the so-called head near a first free end of each sleeve protrudes over a certain height from the top surface of the building block so as to form the first coupling part, whereby the protruding part has a narrowed portion between the first free end and the top surface of the building block, for example in the shape of a circumferential groove at a certain distance from the first free end of the sleeve, and directed parallel to the top surface of the building block, whereby each sleeve extends up to near the opposite bottom surface of the building block, which is provided with a central longitudinal groove there, i.e. a recess directed in the longitudinal direction of the building block, whereby the so-called foot near the second free end of each sleeve is provided in the central longitudinal groove, which foot has a pair of inwardly directed teeth forming the second coupling part.

A major advantage of building blocks in accordance with this practical embodiment is that they are very convenient to use and can also be easily manufactured with simple synthetic insert pieces.

Indeed, thanks to the proper mutual coordination of the dimensions and the positioning of the cylindrical sleeves, and of the longitudinal groove in the bottom surface of the stone component of the building block, and of the dimensions and positioning of the circumferential groove and the facing teeth, building blocks according to the present embodiment of the invention which are placed on top of one another can be very easily coupled thanks to a relative, narrow movement of the building blocks in the longitudinal direction until the teeth engage in the circumferential groove.

Hereby is obtained a coupling of the building blocks whereby resistance is offered both to forces directed parallel to the coupling surfaces, i.e. parallel to the sides or faces of the building blocks which are provided with coupling means, directed in the longitudinal direction as well as transversely to the longitudinal direction of the building blocks, and to forces directed transversely to the coupling surface.

The invention also concerns an insert piece designed to be applied in a building block, as explained above, whereby the insert piece is a cylindrical hollow sleeve with a head provided with a circumferential groove at a certain distance from a free end of the sleeve and with a foot provided with a pair of inward, opposite teeth, whereby two insert pieces placed on top of one another can be coupled by snapping the inward hook-shaped teeth of the foot of a first insert piece in the circumferential groove in the head of a second insert piece, more specifically thanks to a relative movement of the insert pieces towards one another in a direction at right angles to their central axis.

Such insert pieces according to the invention are very easy to manufacture and they are also practical for the manufacturing of and/or to be applied in a building block according to the invention.

In order to better explain the characteristics of the invention, the following preferred embodiment of a building block according to the invention is described as an example only without being limitative in any way, as well as of an insert piece according to the invention for manufacturing such a building block, with reference to the accompanying figures, in which.

Figure 1:
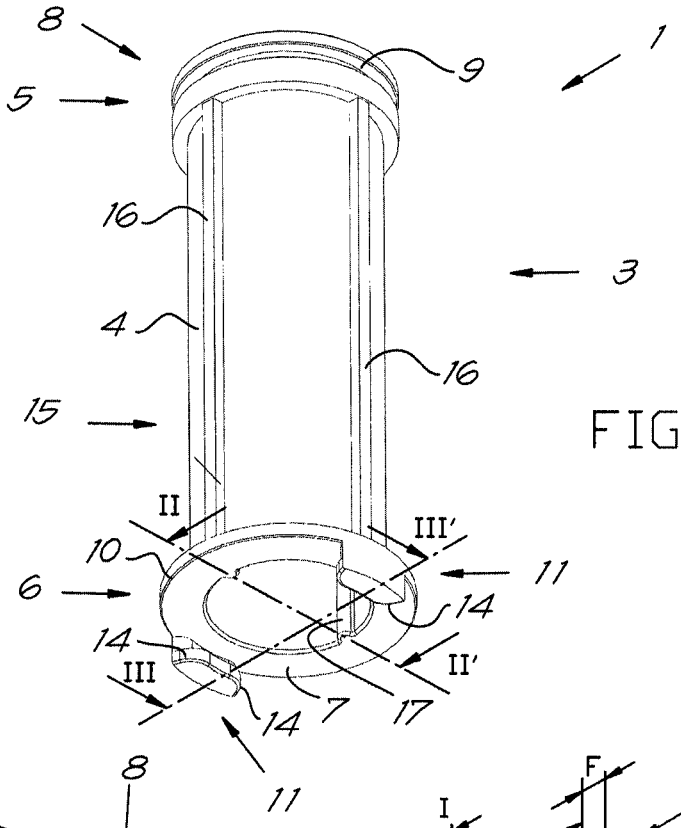
FIG. 1 shows a first embodiment of an insert piece according to the invention, seen in perspective.
Figure 2:
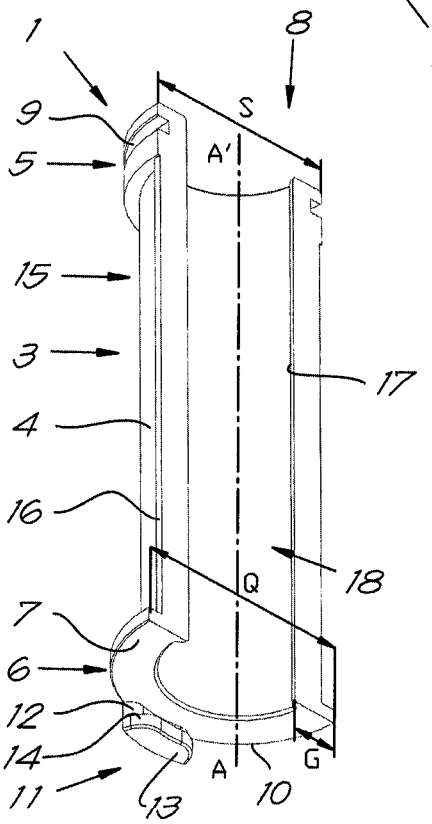
FIGS. 2 and 3 show an insert piece according to FIG. 1, seen in perspective, that is cut according to plane II-II' and plane III-III' respectively.
Figure 3:
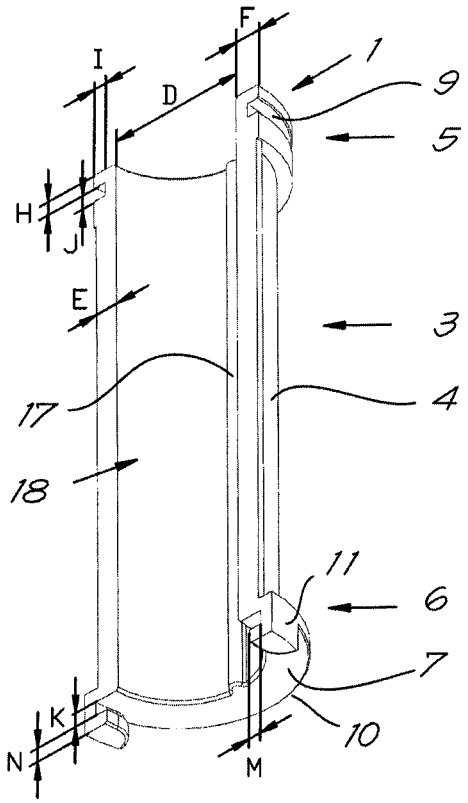

The insert piece 1 represented in FIGS. 1 to 3 is preferably a synthetic insert piece 1, but it can also be made of other materials such as aluminium and steel.

Figure 4:
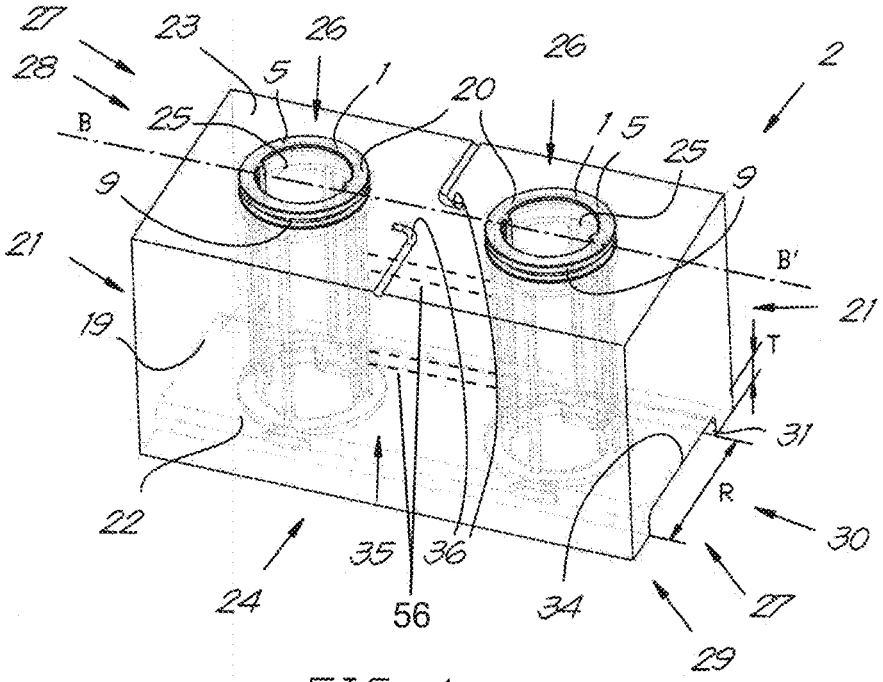
FIG. 4 shows a first embodiment of a building block according to the invention, seen in perspective.

The insert piece 1 is in this case designed for manufacturing a building block 2, as shown in FIG. 4.

In the given embodiment, the insert piece 1 is mainly formed of a cylindrical hollow sleeve 3 having an inside diameter D with a wall thickness E at its central part 4.

The cylindrical hollow sleeve 3 has a widened head 5 with a wall thickness F which is larger than the wall thickness E of the central part 4, as well as a foot 6 provided with a flange 7 which extends radially with a width G which is even larger than the wall thickness F of the head 5.

At a certain distance H from the first free end 8 of the sleeve 3 is provided, in the widened head 5, a continuous circumferential groove 9 having a width J up to a depth I.

At the second free end of the sleeve 3, more specifically on the side edge 10 of the flange 7 forming the foot 6 of the insert piece 1, is provided a pair of inward, opposite hook-shaped teeth 11.

Each tooth 11 is hereby formed of an upright portion 12 extending over a height K, corresponding to the distance H, at right angles to the flange 7, and of a radial portion 13 which is parallel to the flange 7 and directed to the other tooth 11 according to a radial direction over a length M corresponding to the depth I of the groove 9 and having a thickness N corresponding to the width J of the groove 9.

Further, the radial portion 13 of each of the teeth 11 has a rounding 14 on the lateral sides.

On the outer surface 15, the sleeve 3 in the given embodiment is also provided with four longitudinal, external ribs 16 extending between the head 5 and the foot 6 of the insert piece 1.

The insert piece 1 in this case also has two opposed internal ribs 17 extending over the length of the sleeve 3 on the inner side 18 thereof.

By aligning the dimensions of the teeth 11 and the groove 9, more specifically among others as the radial length M of each tooth 11 corresponds to the depth I of the groove 9, and the thickness N of each tooth 11 fits in the width of the groove 9, complementary parts are formed.

Thus, two insert pieces 1 placed on top of one another can be coupled by snapping the inward hooks 11 of the foot 5 of a first insert piece 1 in the circumferential groove 9 in the head 5 of a second insert piece 1, more specifically thanks to a relative movement of the insert pieces 1 towards one another in a direction at right angles to their central axis AA'.

With such an insert piece 1 according to the invention can be made a building block 2 according to the invention, represented in FIG. 4, which can be easily coupled to other such building blocks 2.

Such a building block 2 is formed of a stone body 19 in which, in the given embodiment, are inserted two synthetic insert pieces 1, whereby in this case more specifically the synthetic insert pieces 1 are embedded in the stone body 19 so as to form a synthetic portion 20 of the building block 2.

As an alternative it is of course not excluded, when manufacturing a building block 2 according to the invention, to use more or less insert pieces 1.

The following embodiment may be interesting, for example, whereby only one insert piece 1 is applied, composed of two or several sleeve-shaped parts, as represented in FIG. 4, which are coupled by means of a synthetic bridge 56, such that the correct distance between the sleeve-shaped parts is always automatically maintained while the building block 2 is being cast.

The building block 2 is essentially beam-shaped with a pair of end faces 21, a pair of side flanks 22, a top surface 23 and a bottom surface 24.

The two synthetic insert pieces 1 are hereby centrally provided between the two side flanks 22 of the building block 2, whereby the sleeve-shaped, hollow synthetic insert pieces 1 each form a cylindrical wall 25 of a passage 26 extending over the height of the building block 2 from the bottom surface 24 to the top surface 23.

Typical for a building block 2 according to the invention is that it is provided with coupling means 27, whereby adjacent building blocks 2 can be coupled immovably but yet detachably to one another by making the coupling means 27 concerned work in conjunction with one another.

More specifically, the coupling means 27 contain a first synthetic coupling part 28 protruding from the top surface 23 of each building block 2 and a second coupling part 29 which is complementary thereto on the bottom surface 24 of such a building block 2.

The head 5 of each cylindrical sleeve 3 hereby protrudes from the top surface 23 of the building block 2 over a height O so as to form the first coupling part 28.

In the given example, the height O is the sum of the distance H up to the groove 9, the width J of the groove 9 and also a minimum clearance P.

The protruding part 28 between its head 5 and the top surface 23 hereby has a narrowed portion 9 which in this case is formed of circumferential grooves 9 in the insert pieces 1.

Each cylindrical sleeve 3 extends into a central longitudinal groove 30 provided in the bottom surface 24 of the stone body 19 of the building block 2.

In other words, the central longitudinal groove 30 is directed according to the longitudinal direction BB' of the building block 2, and the foot 6 of the cylindrical sleeve 3 is situated in this central longitudinal groove 30.

This longitudinal groove 30 is delimited on either side by two side walls 31, and while each insert piece 1 is being embedded in the building block 2, it is made sure that the pair of inward teeth 11 on each foot 6 thereof extends at right angles to these side walls 31 of the longitudinal groove 30 so as to form the second coupling part 29.

The cylindrical sleeves 3 hereby have an outer diameter Q at their foot 6 which is smaller than the width R of the longitudinal groove 30 in the bottom surface 24 of the building block 2 and, since in this case the heads 5 of the insert pieces 1 are also made narrower than the feet 6, the outer diameter S of such a head 5 is also smaller than the width R of the longitudinal groove 30.

The height O over which the heads 5 of the insert pieces 1 protrude from the top surface 24 is further smaller than the depth T of the longitudinal groove 30 in the bottom surface 24, whereas the sum U of the height of the teeth and the thickness of the flange 7 of the feet 6 corresponds to the depth T of the groove 30.

The dimensions of the insert pieces 1 and the stone body 19, as well as the positioning of the insert pieces 1 in the stone body 19 are hereby such that the heads 5 of the insert pieces 1 of a lower building block 2 fit in the longitudinal groove 30 of an upper building block 2, whereby such building blocks 2 placed on top of one another may still undergo a narrow, relative movement in relation to one another according to the longitudinal direction BB', or in other words a movement towards one another along their coupling surfaces.

Figure 7:
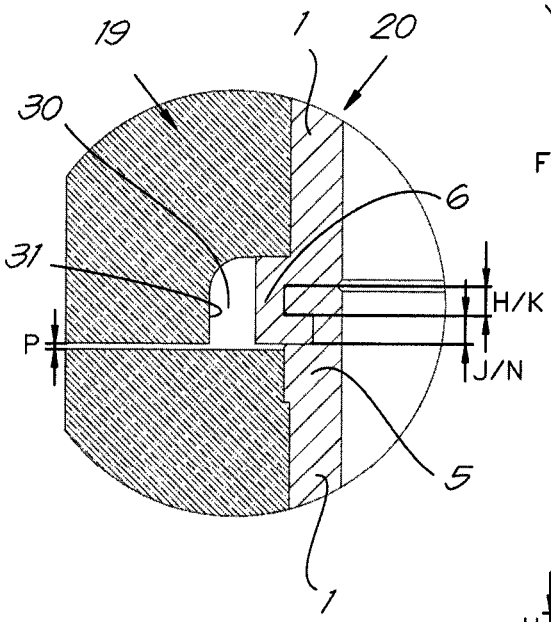
FIG. 7 is a magnified representation of the portion indicated by F7 in FIG. 6.
Figure 6:
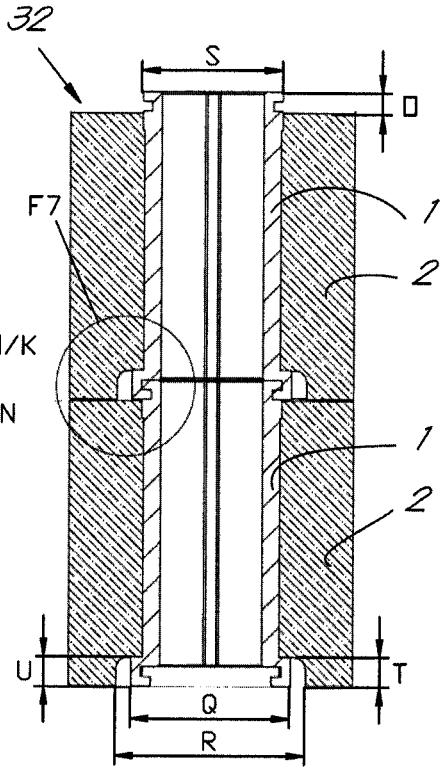
FIG. 6 shows a section through the wall portion from FIG. 5, indicated by line VI-VI'.
Figure 8:
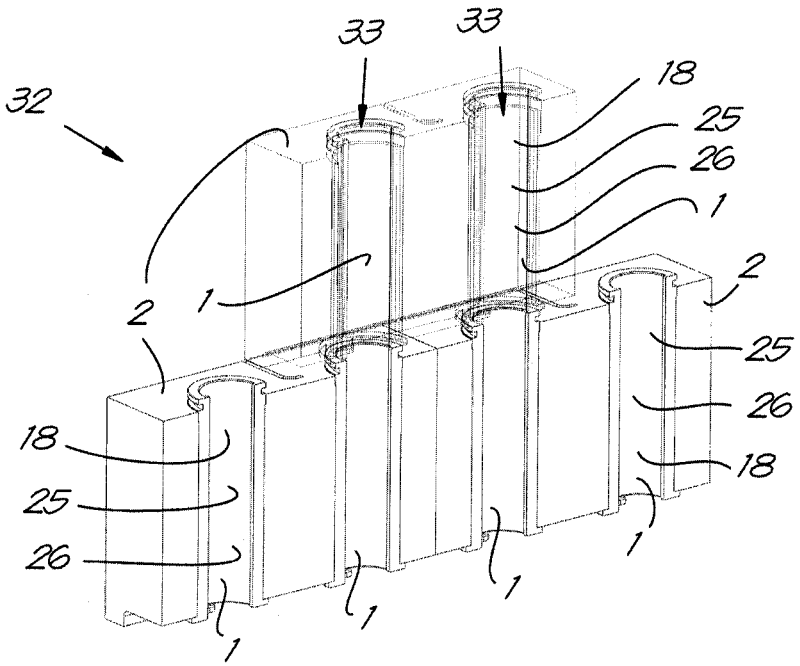
FIG. 8 is a perspective view of a portion of the wall from FIG. 4, cut according to plane VIII-VIII'.
Figure 9:
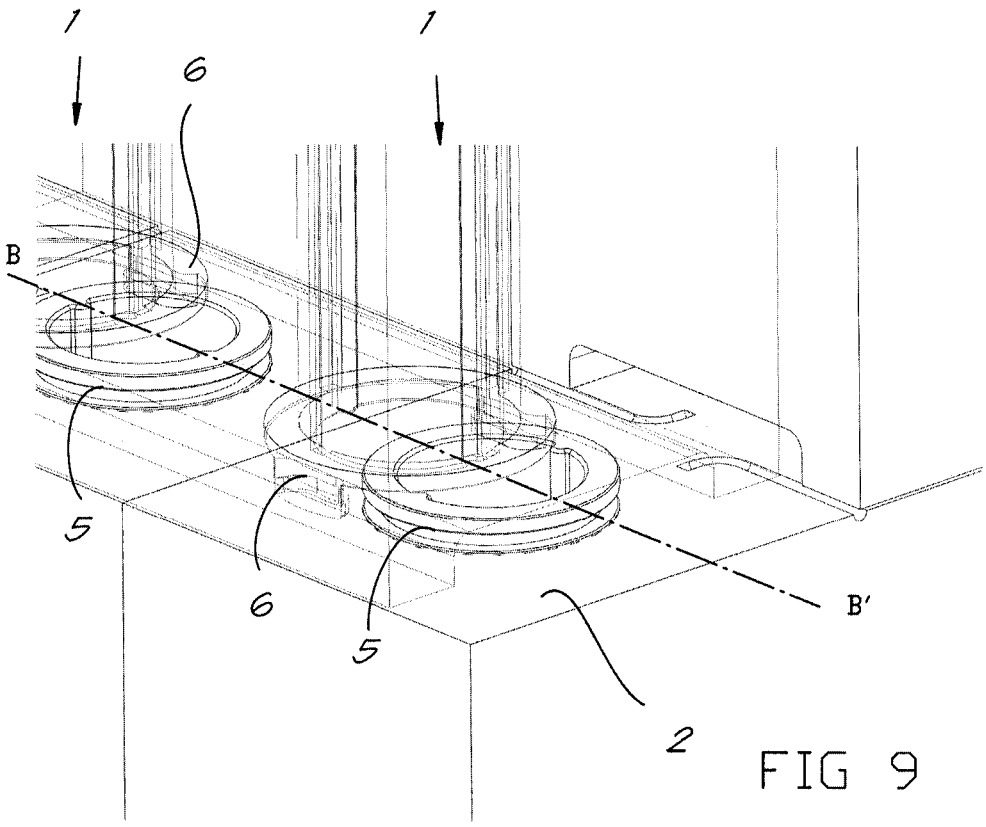
FIG. 9 shows, magnified and in perspective, how two building blocks according to the invention, more specifically at portion F9, can be coupled; and, FIGS. 10 to 19 show, in a manner entirely analogous to that in FIGS. 1 to 9, a second embodiment of an insert piece and a building block according to the invention, as well as a wall portion built with such building blocks.

The circumferential groove 9 in the head 5 of the insert pieces 1 and the facing teeth 11 on the foot 6 of the insert pieces 1 are hereby furthermore adjusted to one another in such a way that, during an aforesaid progressing motion of building blocks 2 placed on top of one another according to the longitudinal direction BB', illustrated in more detail in FIG. 9, the facing teeth of the feet 6 of the insert pieces 1 of the upper building block 2 snap in the circumferential groove 9 in a head 5 of the insert pieces 1 of the lower building block 2, which is illustrated in greater detail in FIGS. 6 to 8.

For clarity's sake, the terms top surface 23 and bottom surface 24 are used in this text, but it is clear that, according to the invention, the building blocks 2 can of course be turned or placed according to other orientations in practice.

The orientation suggested in this text offers the advantage, however, that the protruding part 28 of the building block 2 is located at the top, which simplifies the stacking.

Figure 5:
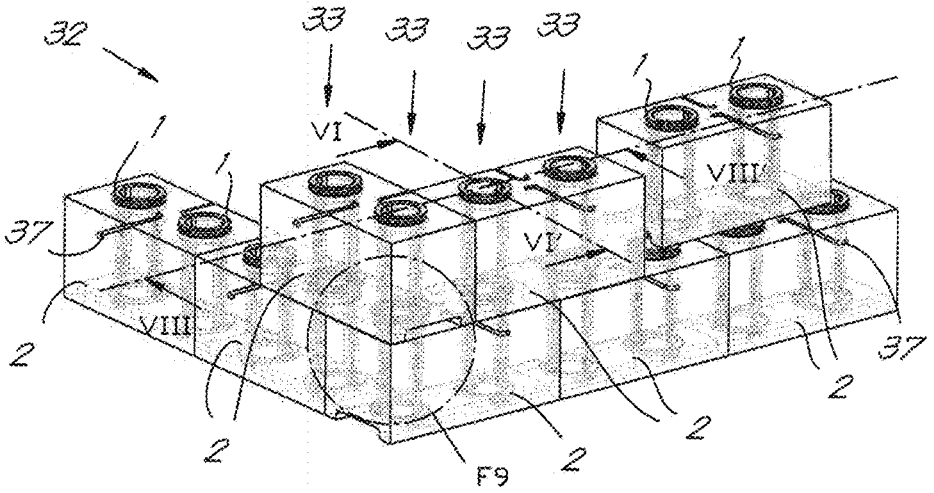
FIG. 5 is a perspective view of a portion of a wall, built with building blocks according to the invention according to FIG. 4.

In this manner, a wall section 32 can be built very quickly and efficiently, as represented in FIGS. 5 and 8, whereby the stone bodies 19 of the building blocks 2 rest on one another, while the building blocks 2 concerned are actually coupled by means of synthetic portions 20.

This does not require the use of any mortar or glue, and the wall section 32 can be easily disassembled again by narrowly moving apart building blocks 2 situated on top of one another according to their longitudinal direction BB', in other words by moving them apart along their coupling surfaces.

When composing a wall section 32, the passages 26 of the building blocks 2 are vertically aligned to one another, whereby in the wall section 32, continuous vertical hollow columns 33 are formed, which may be convenient for installing cables or the like.

The building blocks 2 represented in the figures can also be manufactured very easily by placing two insert pieces 1 in an appropriate way in a container-shaped mould and by casting a concrete mortar into the mould, possibly followed by vibrating and/or pressing, after which the mould can be removed and the thus obtained semi-finished building blocks can dry further.

According to a practical method, a board or the like is supplied on which are placed, per building block 2 to be manufactured, in this case two synthetic insert pieces 1, and a wall formwork is provided thereon which is open at the bottom and at the top.

This wall formwork may be provided with two positioning means at the top, for example two downwardly directed conical elements provided at precise distances in relation to the walls of the wall formwork, in view of any possible adjustments of the positioning of the two synthetic insert pieces 1.

After the casting and possible vibrating and pressing of the concrete, the wall formwork is moved upwards, and the board or the like with the semi-finished building blocks on it can be moved to an appropriate drying area.

Naturally, the invention is not restricted to the embodiment of an insert piece 1 and a building block 2 as discussed above.

A few aspects that are preferably taken into account in general are the following ones.

According to a preferred embodiment of a building block 2 according to the invention, the first coupling part 28 is formed of at least one central, protruding part having a certain maximum width and protruding over a certain maximum height from the top surface 23 of the building block 2, and the bottom surface 24 is provided with a longitudinal groove 30 with a bottom 34 and two opposed side walls 31, which groove 30 is formed in the stone body 19 of the building block 2 and extends centrally through the bottom surface 24 according to the longitudinal direction BB' of the building block 2 at a depth T and a over width R, which are larger than the maximum height and the maximum width respectively of the at least one protruding part on the top surface 23, such that when putting an upper building block 2 on top of a lower building block 2, the protruding part of the lower building block 2 fits in the groove of the upper building block 2, and both building blocks 2 can be narrowly moved over one another according to their longitudinal direction BB', or in other words along the coupling surfaces, at least over a part of their length.

According to a preferred characteristic of a building block 2 according to the invention, the second coupling part 29 extends in the longitudinal groove 30 in the bottom surface 24, whereby the second coupling part 29 restricts an aforesaid narrow mutual movement of building blocks 2 placed on top of one another in the longitudinal direction BB'.

The first coupling part 28 and the second coupling part 29 are hereby preferably complementary to such an extent that, when they engage, also a movement apart of the building blocks concerned in a direction at right angles to the longitudinal direction BB' is hindered, in the coupling surface as well as transversely to the coupling surface.

Another aspect of the invention consists in that, between the head of the at least one protruding part and the top surface 23, the protruding part is provided with a narrowed portion 9, and the second coupling part 29 contains at least a pair of facing teeth 11 extending transversely to the opposed side walls 31 of the groove 30 in the bottom surface 24, and whereby, as a result of an aforesaid narrow movement of building blocks 2 in relation to one another, the facing teeth 11 of the upper building block 2 hook in the narrowed portion 9 of the protruding part of the lower building block 2.

Nor is it excluded, according to the invention, to provide additional coupling means 35 for coupling building blocks 2, among themselves or with other architectural elements such as for example a second facade sheet in a cavity wall construction, for example, as in the embodiment represented in the figures, by providing grooves 36 in the building blocks 2 in which a metal connecting rod 37 or element can be inserted.

It is also possible to provide the building blocks 2 according to the invention with an insulating layer.

FIGS. 10 to 13 represent another possible embodiment of an insert piece 1 according to the invention, whereby such an insert piece 1 in this case also forms a cylindrical hollow sleeve 3 made of two parts 38 and 39, however, a headpiece 38 and a base 39 respectively, which are screwed into each other.

The headpiece 38 is, as in the preceding embodiment, made of a cylindrical headpiece part 40, which in this case forms only a part of the central part 4 of the insert piece 1, however, and whereby, as in the preceding embodiment, a widened head 5 connects onto the cylindrical headpiece part 40.

The cylindrical headpiece part 40 has a wall thickness E and an outer diameter D', whereby an external thread 42 is provided on the free end 41 of the cylindrical headpiece part 40, on the outer surface 15.

Figure 18:
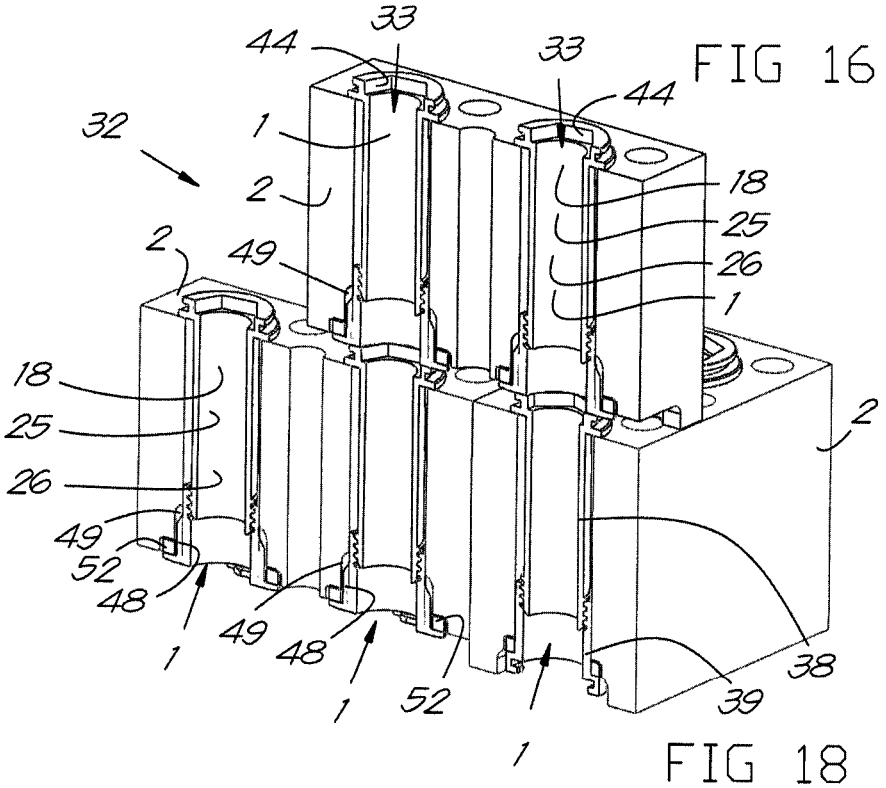
Figure 19:
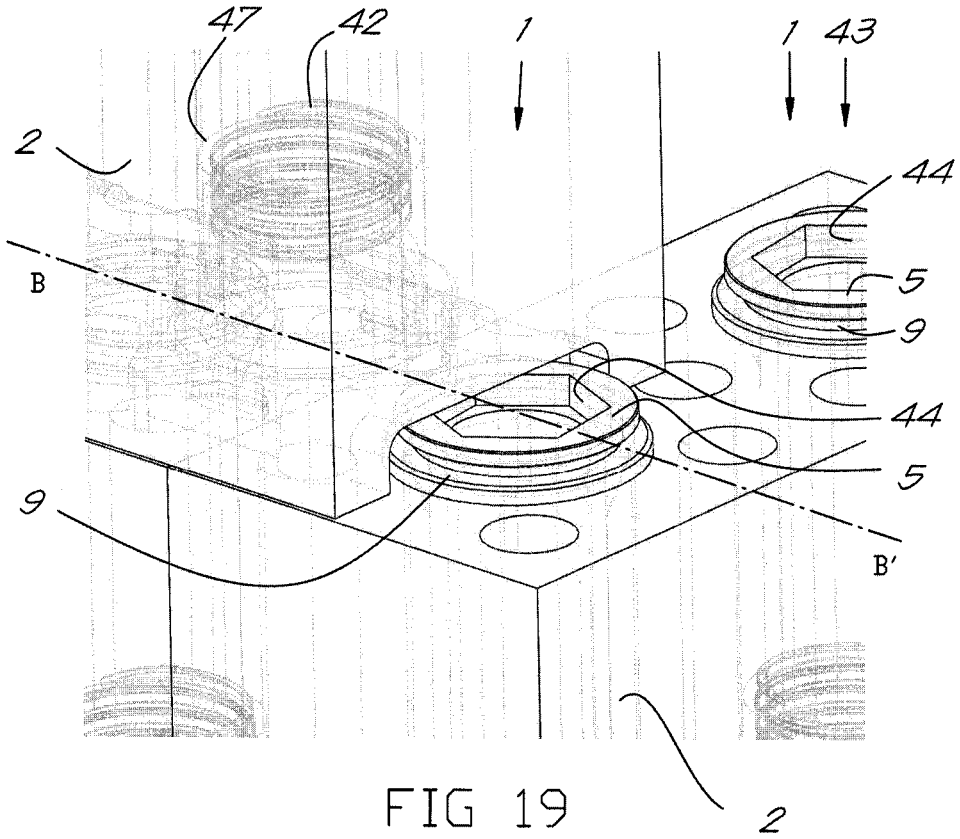

The widened head 5 of the headpiece 38 in this second embodiment also has a slightly different construction, more specifically in the shape of a hexagon socket head, which is illustrated more clearly in FIGS. 18 and 19, whereby the internal opening 43 in the headpiece 38 on the free end 8 of the widened head 5 is provided with a hexagonal opening 44, which opening 44 is designed to make it possible to rotate the headpiece 38 by means of a hexagonal Allen key.

In the widened head 5 is still provided, as in the preceding embodiment, a continuous circumferential groove 9 having a depth I and a width J, whereby this groove 9 has the same function as in the preceding embodiment.

The base 39 is, just as in the preceding embodiment, provided with a widened foot 6 with a flange 7 connecting to a cylindrical base part 45 which also forms a part of the central part 4 of the insert piece 1.

This cylindrical base part 45 has an inner diameter D corresponding to the outer diameter D' of the cylindrical headpiece part 40, whereby near the free end 46 of the cylindrical base part 45, on the inner side 18 thereof, is provided an internal thread 47 which can work in conjunction with the external thread 42 of the cylindrical headpiece part 40.

On the outer surface 15 of the base 39 are provided a number of external ribs 48, more specifically in this case two ribs 48 which are diametrically opposed, whereby the ribs extend in a direction parallel to the central axis AA' of the base 39.

As can be seen for example in the cross-section of FIG. 18, the base 39 is to be provided in a passage 26 of a stone body 19, whereby the external ribs 48 are provided in slots 49 provided laterally on this passage 26 and which are complementary to the external ribs 48, such that after the base 39 has been applied in the passage 26, the base 39 can no longer rotate in relation to the stone body 19.

Also, these external ribs 48 may be regarded as a kind of blocking agents to prevent any rotation of the base 39.

Figure 13:
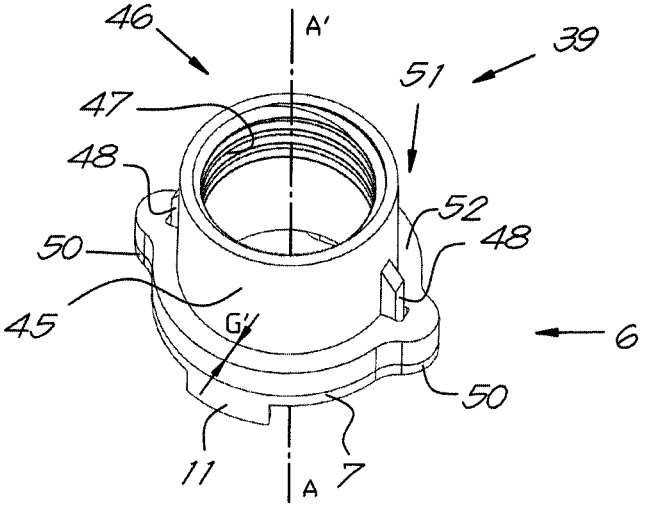

As is clearly illustrated in FIG. 13, the flange 7 on the base 39 also differs somewhat from that in the preceding embodiment, whereby the flange 7 is not circular, but is provided with a kind of protuberances or ears 50, more specifically at the external ribs 48, such that the whole cylindrical base part 45 as well as the external ribs 48 are surrounded by a continuous strip 51 with a constant width G' formed by the flange 7.

Figure 17:
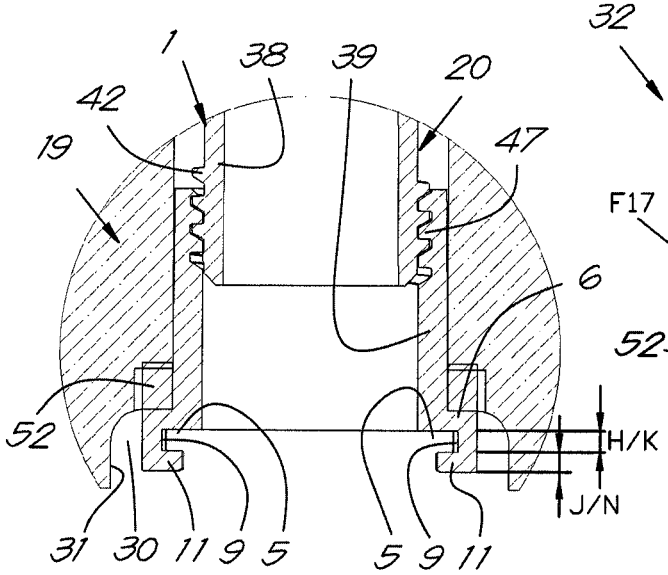
Figure 16:
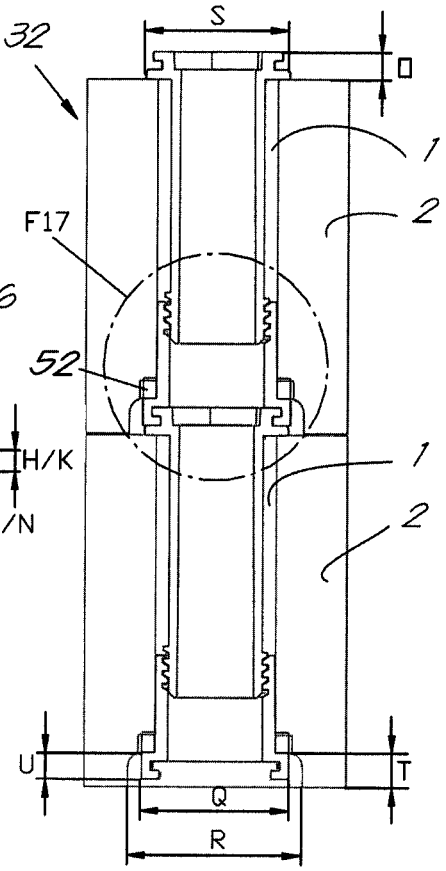

Indeed, the strip 51 on the flange 7 in this second embodiment serves as a supporting surface 7 for a rubber ring 52, which is provided between the flange 7 and a stone body 19 of a building block 2 according to the invention, which is represented in greater detail for example in FIG. 17.

On the outer surface 15 of the headpiece 38 there are further a number of short external supports 53, in this case four external supports 53, evenly distributed over the circumference of the cylindrical headpiece part 40, whereby the external supports 53 have a flat, triangular shape, one rectangular side of which supports the head 5.

It is important to note that these supports 53, as opposed to the external ribs 48 of the base 39, are not designed to hinder the rotation of the headpiece 38 in a stone body 19.

Indeed, when the headpiece 38 has been screwed in the base 39, the supports 53 are situated inside the imaginary cylinder 54 with a diameter Q extending as of the cylindrical base part 45 up to the head 5.

Thus, the supports 53 make sure that the headpiece 38 remains nicely centred when the headpiece 38 is inserted in a passage 26 in a stone body 19 of a building block 2 according to the invention, whereas the headpiece 38 can nevertheless still rotate in the passage 26, more specifically by turning the headpiece 38 provided in the hexagonal opening 44 by means of an Allen key.

In this version, in the mounted state, there is a certain opening between the headpiece and the stone body 19, which is not so in the embodiment with embedded insert pieces 1.

The flange 7 of the base 39 is still provided, as in the preceding embodiment, with a pair of opposite teeth 11, which teeth 11 have exactly the same function and can thus work in conjunction with the circumferential groove 9 provided in a headpiece 38 of an adjacent insert piece 1 in order to couple the insert pieces 1 concerned.

Figure 10:
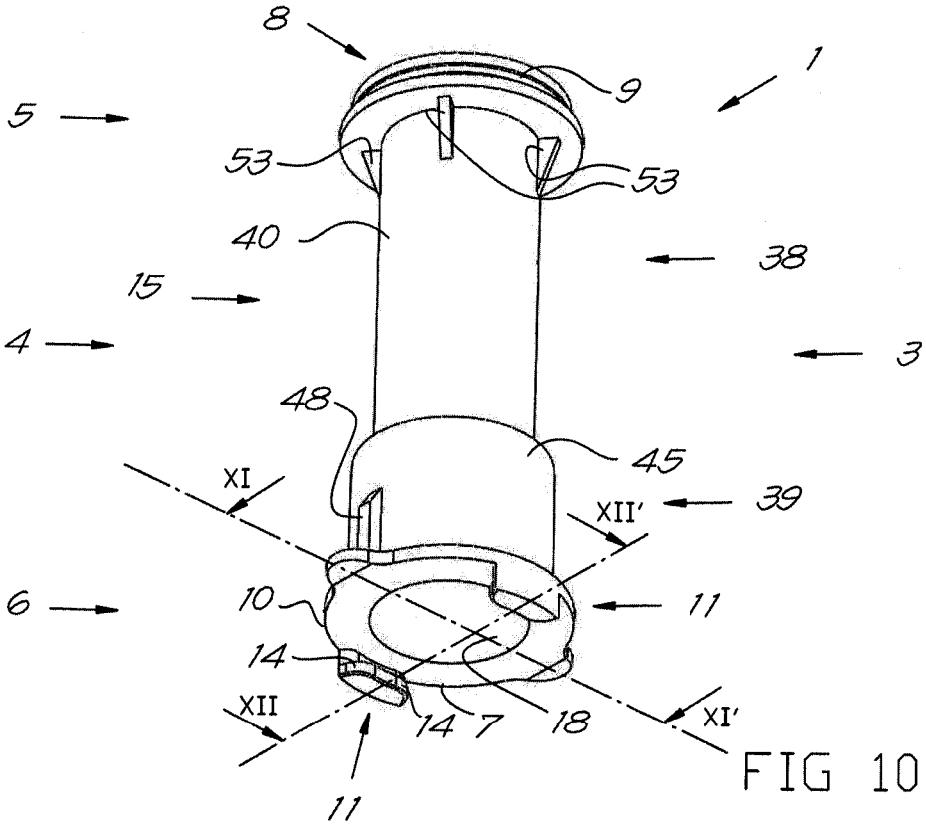
Figure 11:
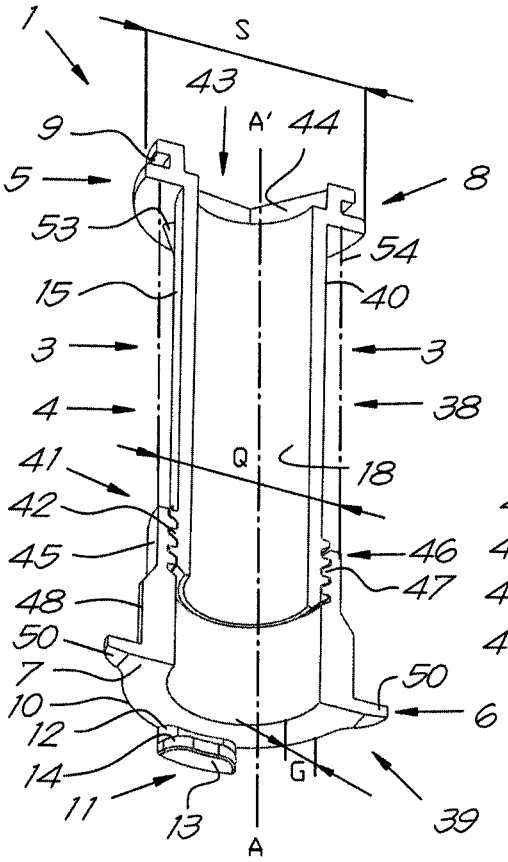
Figure 12:
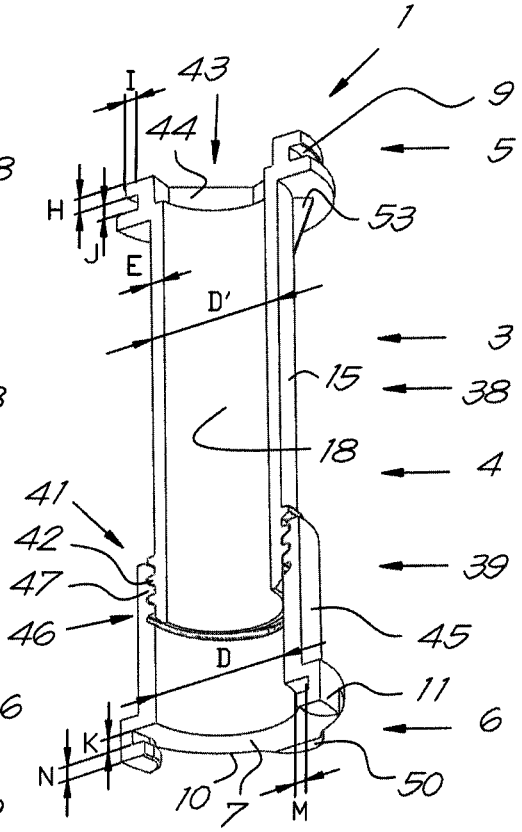

Such insert pieces 1 according to the embodiment of FIGS. 10 to 12 are extremely practical for coupling building blocks 2 according to the invention, as is illustrated in FIGS. 14 to 19.

The major difference with the preceding embodiment of an insert piece 1 and a building block 2 according to the invention is that the two-piece insert pieces 1 are designed to be provided in the stone body 19 after this stone body 19 has already hardened to thus compose a building block 2 with coupling means 27, whereby the insert pieces 1 are not embedded in the building block 2 while it is being manufactured, however.

A base 30 with a rubber ring 52 is hereby first provided on the bottom of the stone body 19 in a passage 26 thereof, which is completely blocked against rotation, as explained above, thanks to the cooperation of the external ribs 48 on the base 39 and the slots 49 at the passage 26.

Next, a headpiece 38 is provided in the passage 26, on the top side of the stone body 19, which can be screwed down to the base 38 by means of an Allen key.

The rubber ring 2 has a certain elasticity, as a result of which variations in height of the stone body 19, for example due to manufacturing tolerances, can be easily compensated, whereas by screwing down the headpiece 38 this rubber ring 2 is also tightened, such that the assembled insert piece 1 is prevented from coming loose in an unwanted manner.

Figure 14:
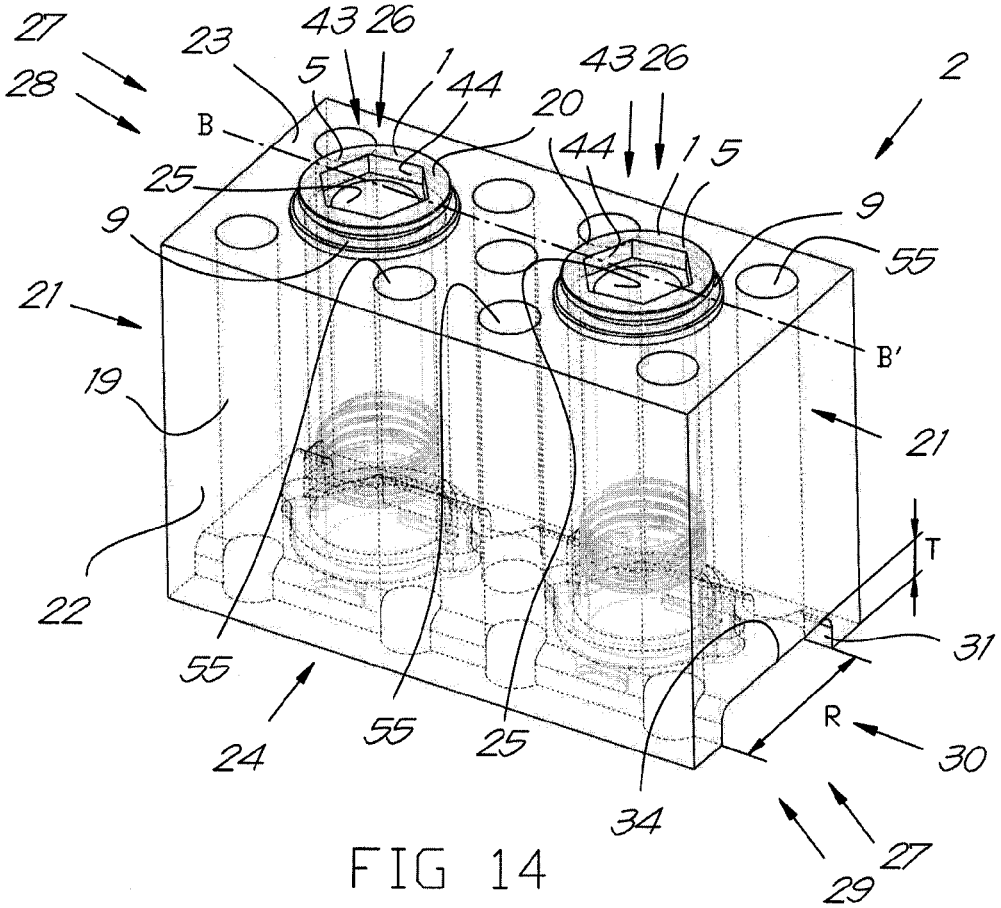
Figure 15:
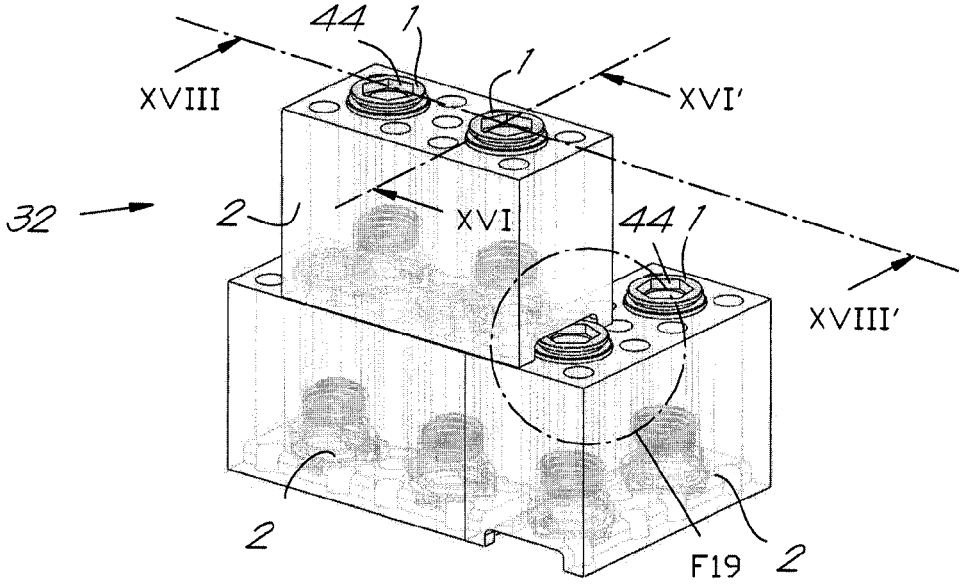

In the embodiment shown in FIG. 14, also holes 55 are provided in the stone body 19, next to the passages 26 for insert pieces 1.

These holes 55 can be used for example for inserting insulation, or they may serve as additional channels in a wall section 32 for applying electric cables or the like.

The holes 55 can possibly also be used for inserting a reinforcement or for injecting some substance forming such a reinforcement after it has hardened or which is used as an insulation.

Naturally, many other embodiments of an insert piece 1 and a building block 2 according to the invention are not excluded either.

In the second embodiment, the two-piece insert pieces 1 can be assembled in a stone body 19 as the headpiece 38 and the base 39 can be connected by screwing them together by means of the threads 42 and 47.

Naturally, it is not excluded according to the invention to apply other systems for connecting the base 39 and the headpiece 38, such as for example a click or snap connection, a bayonet catch or the like.

The headpiece 38 and the base 39 can also be connected by providing either one with external teeth and by providing the other part with internal teeth which can cooperate with the external teeth, whereby the part with external teeth is pushed or knocked in the part with internal teeth, for example by means of a hammer or the like, and whereby while the external teeth penetrate in the internal teeth, both teeth are simultaneously elastically deformed.

The invention can also be described in a broader sense as a combination of a building element, preferably in the shape of a stone body 19, with one or several insert pieces 1 which are or can be inserted and fixed in the building element, and which serve as coupling means 27 with which such building elements can be coupled to one another.

The insert pieces are hereby provided with a first coupling part 28 protruding from a first surface 23 of the building element after the assembly, and a complementary second coupling part 29 situated in an opposite surface 24 of the building element after the assembly.

The first coupling part 28 and the second coupling part 29 are complementary in such a way that, after adjacent building elements have been coupled, the coupled building elements concerned are coupled to each other in an immobile but possibly detachable manner by making the coupling means 27 work in conjunction with one another.

In the first embodiment of FIGS. 1 to 9, such a combination forms a building block 2 provided with coupling means 27 to be coupled to an adjacent, similar building block 2, whereby one or several insert pieces 1, made for example of a synthetic material, are embedded in the body 19 during the manufacturing of the building block 2 and are thus fixed therein while the body 19 hardens.

In the second embodiment of FIGS. 10 to 19, such a combination contains at least one insert piece 1 with two parts 38 and 39 which can be coupled to one another and whereby this insert piece 1 can be fixed in the body 19 by said coupling so as to form a building block 2 provided with coupling means 27 to be coupled to an adjacent, similar building block 2.

In this second embodiment, the insert pieces 1 are thus fixed in the building element in a later stage, more specifically after the body 19 has already hardened.

In yet another embodiment, not represented in the figures, a somewhat different principle may be applied, whereby the aforesaid combination of a building element and at least one insert piece 1 is such that the insert piece 1 can be provided loosely in the building element, but whereby by coupling this combination to an adjacent, similar combination, the aforesaid insert piece 1 is also fixed in the building element.

In other words, in this embodiment, the insert piece 1 is initially not fixed in the building element, but is only fixed while being coupled to another building element.

In a preferred embodiment, the latter is obtained by designing the insert piece 1 such that the first coupling part 28 and the complementary second coupling part 29 together form a bayonet catch.

The insert piece 1 may hereby be sleeve-shaped and provided with a widened foot, such that after it has been provided in a corresponding sleeve-shaped hole in the building element, it can rest with its foot against the building element.

After having been coupled to another insert piece by a combined movement consisting of a translation and a rotation, the insert piece can then be fixed in the building element.

The bayonet catch is hereby preferably such that the insert piece is tightened somewhat in relation to the widened foot.

An alternative embodiment may consist in designing the insert piece 1 as a synthetic plug, whereby the first coupling part 28 is provided with external teeth and the second coupling part 29 is provided with internal teeth, and whereby by inserting the external teeth of a synthetic insert piece 1 of an adjacent building element in the aforesaid internal teeth, the plug expands, such that it can be fixed in the building element concerned.

It is clear that also in this embodiment, the insert piece is only fixed in the building element after it has been coupled to another building element.

The invention is by no means restricted to the embodiments of an insert piece 1 as well as of a building block 2 according to the invention, described by way of example and represented in the accompanying figures; on the contrary, such an insert piece 1 or such a building block according to the invention can be made in many other ways while still remaining within the scope of the invention.

The invention claimed is:

1. A building block for construction of walls and partitions of a building or the like extending in a longitudinal direction, the building block comprising:

a coupling having a first coupling part protruding from a first surface of the building block and a complementary second coupling part on an opposite surface of the building block, whereby the first coupling part and the second coupling part are complementary and whereby, during assembly of a plurality of the building blocks, the first coupling part of a first building block and the second coupling part of an adjacent building block can work together to couple the building blocks, wherein the building block is provided with a body in which one or more insert pieces are inserted, whereby the first and second coupling parts are formed of said one or more insert pieces, whereby the first coupling part and the second coupling part are complementary in a way that, after adjacent building blocks have been coupled, the coupled building blocks are connected together causing the couplings of stacked building blocks to work in conjunction with one another, wherein the insert piece of the building block can be coupled with an insert piece of an adjacent building block by longitudinally moving a spaced apart pair of inward hook-shaped teeth of a foot of the first coupling part associated with a first building block into engagement with spaced apart longitudinal groove sections in a head of the second coupling part associated with an adjacent building block.

2. The building block according to claim 1, wherein the hook-shaped teeth of the first coupling part extend in the longitudinal groove sections of the second coupling part when engaged and thus restricting movement separating the building blocks in a direction at right angles to the longitudinal direction.

3. The building block according to claim 1, wherein the building block is provided with a pair of passages extending over a height of the building block from a bottom surface to a top surface of the building block, and whereby the passages are delimited by walls which extend around the two insert pieces.

4. The building block according to claim 3, wherein the building block is provided with two passages having a cylindrical wall.

5. The building block according to claim 1, wherein the body is formed of stone and the one or more insert pieces are provided by two synthetic insert pieces embedded in the body.

6. The building block according to claim 5, wherein ends of the two synthetic insert pieces have an external diameter which is smaller than a width of a longitudinal groove in a bottom surface of the body, and in that a height of the body over which the heads of the insert pieces protrude from a top surface of the body is smaller than a depth of the longitudinal groove in the bottom surface, configured so that the heads of the insert pieces of a lower building block of a stacked pair of building blocks fit in the longitudinal groove of an upper building block to allow restricted, movement of the building blocks in relation to one another, in the longitudinal direction.

7. The building block according to claim 6, wherein the longitudinal groove sections are formed by a circumferential groove in the heads of the one or more insert pieces and facing teeth on the foot ends of the one or more insert pieces of an adjacent building block engage one another in a way that during the placement of building blocks on top of one another, the inward hook-shaped teeth on the foot of the one or more insert pieces of the upper building block snap in the circumferential groove of the head of the one or more insert pieces of the lower building block.

8. The building block according to claim 1, wherein the one or more insert pieces each comprise a two-piece insert having a headpiece and a base, whereby the headpiece and the base can be assembled in the body and connected to one another.

9. The building block according to claim 8, wherein the headpiece and the base are connected to one another by a threaded joint.

10. The building block according to claim 1, wherein the one or more insert pieces have a central axis and that two insert pieces of adjacent building blocks put on top of one another can be coupled by snapping inward hook-shaped teeth of a foot of a first insert piece in a circumferential groove in a head of a second insert piece thanks to a relative movement of the insert pieces towards one another in a direction at right angles to said central axis.

11. The building block according to claim 1, wherein each building block has only one insert piece, composed of a plurality of sleeve-shaped parts, which are coupled by a synthetic bridge.

* * * * *